US008124921B2

(12) United States Patent
Geswender et al.

(10) Patent No.: US 8,124,921 B2
(45) Date of Patent: Feb. 28, 2012

(54) METHODS AND APPARATUS FOR GUIDANCE OF ORDNANCE DELIVERY DEVICE

(75) Inventors: Chris E. Geswender, Green Valley, AZ (US); Stephen E. Bennett, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 558 days.

(21) Appl. No.: 12/340,950

(22) Filed: Dec. 22, 2008

(65) Prior Publication Data

US 2012/0018567 A1 Jan. 26, 2012

Related U.S. Application Data

(60) Provisional application No. 61/048,046, filed on Apr. 25, 2008.

(51) Int. Cl.
*F42B 15/01* (2006.01)
*F42B 15/00* (2006.01)

(52) U.S. Cl. ..... 244/3.1; 244/3.11; 244/3.15; 244/3.24; 89/1.11; 102/200; 102/206; 102/211; 102/382; 102/384

(58) Field of Classification Search ..... 342/61–68, 342/175, 195; 89/1.11, 1.1, 6, 6.5; 244/3.1–3.3, 244/138 R, 139; 102/200, 206, 211–214, 102/382, 384, 293
See application file for complete search history.

(56) References Cited

U.S. PATENT DOCUMENTS

| | | | | |
|---|---|---|---|---|
| 3,164,339 | A * | 1/1965 | Schroader et al. | 244/3.13 |
| 3,749,333 | A * | 7/1973 | Lykken et al. | 244/3.15 |
| 3,999,729 | A * | 12/1976 | Muhlfelder et al. | 244/3.21 |
| 5,435,503 | A * | 7/1995 | Johnson et al. | 244/3.15 |
| 6,471,160 | B2 * | 10/2002 | Grieser | 244/139 |
| 6,502,786 | B2 * | 1/2003 | Rupert et al. | 244/3.27 |
| 6,830,213 | B1 * | 12/2004 | Gehlot et al. | 244/3.19 |
| 6,883,747 | B2 * | 4/2005 | Ratkovic et al. | 244/3.15 |
| 6,896,220 | B2 * | 5/2005 | McKendree et al. | 244/3.15 |
| 6,959,893 | B1 | 11/2005 | Sadowski et al. | |
| 7,163,176 | B1 * | 1/2007 | Geswender et al. | 244/3.27 |
| 7,207,517 | B2 * | 4/2007 | McKendree et al. | 244/3.15 |
| 7,367,525 | B2 * | 5/2008 | McKendree et al. | 244/3.15 |
| 2002/0117580 | A1 | 8/2002 | Rupert et al. | |

FOREIGN PATENT DOCUMENTS

| | | |
|---|---|---|
| WO | 2005015115 A1 | 2/2005 |
| WO | 2006028485 A1 | 3/2006 |

OTHER PUBLICATIONS

International Searching Authority "International Search Report," mailed Aug. 14, 2009; International Application PCT/US2009/041445, international filing date Apr. 22, 2009.

* cited by examiner

*Primary Examiner* — Bernarr Gregory
(74) *Attorney, Agent, or Firm* — Schwegman, Lundberg & Woessner P.A.; Gregory J. Gorrie

(57) ABSTRACT

A guidance system according to various aspects of the present invention operates in conjunction with a suite of different ordnance delivery devices. In one embodiment, the guidance system comprises an interface configured to attach to the ordnance delivery devices in the suite, such as via the fuze well. The guidance system may further include a control system adapted to attempt to establish communications with a subsystem of the ordnance delivery device and operate the guidance system as a standalone guidance system if the attempt fails. The guidance system may further include a control surface interchangeably attachable, for example via an interchangeable control surface module.

23 Claims, 5 Drawing Sheets

METHODS AND APPARATUS FOR GUIDANCE OF ORDNANCE DELIVERY DEVICE

CROSS-REFERENCES TO RELATED APPLICATIONS

This application claims the benefit of U.S. Provisional Patent Application No. 61/048,046, filed Apr. 25, 2008, and incorporates the disclosure of such application by reference.

BACKGROUND OF THE INVENTION

Among the various designs of ordnance delivery devices, there are two extremes. At one end of the spectrum are unguided ordnance delivery devices—those systems for which trajectory is determined by the firing conditions and the environmental conditions of the flight path. At the other end of the spectrum are seven degree of freedom guided ordnance delivery devices—those systems for which trajectory may be modified in flight according to information relating to its actual trajectory and for which translation along each axis, rotation about each axis, and time of impact may be modified by a control system. While guided ordnance delivery devices generally provide the benefits of increased accuracy and precision, the systems required to provide guidance to an ordnance delivery device generally increase the cost of the ordnance delivery device compared with an unguided equivalent.

Guidance systems may take various forms. Such systems may use external information sources such as laser targets, satellite navigation systems, electromagnetic signals, visual data, etc. Such systems may alternatively comprise inertial guidance systems such as linear accelerometers, angular accelerometers, gyroscopes, etc. Such systems may further combine inertial guidance with external information sources in an integrated or independent configuration. Whether a guidance system uses inertial guidance or external information sources, the information obtained may be used to approximate the actual trajectory of the ordnance delivery device. With this approximation, the guidance system may be configured to compare the actual trajectory with the desired trajectory. If the comparison suggests that course correction is necessary, the system may actuate a control surface to modify the actual trajectory.

A variety of control surfaces are generally distinguishable by method of actuation and desired effect. As to methods of actuation, these include extension of a deflector, extension of a fin, extension of a combination of deflectors and fins, selective deformation of a nosecone, rotation of a portion of the control surface, de-rotation of a portion of the control surface, directed ejection of mass, activation of a gyroscope, combinations thereof, and/or the like. As to desired effect, these include imparting a resultant force such that the ordnance delivery device is displaced along at least one of the x-y-z axes, imparting a resultant torque such that the ordnance delivery device is rotated about at least one of the x-y-z axes, imparting a combination of resultant forces and/or resultant torques such that the ordnance delivery device is displaced and/or rotated with respect to at least one of the x-y-z axes, combinations thereof, and/or the like. These methods of actuation and desired effects may be better suited to some ordnance delivery device events than others. For example, assuming that a 7-DOF guidance system is more costly than a 1-DOF guidance system and assuming that some targets are more valuable than others, it may be desirable to reserve the more expensive guidance systems for higher value targets.

Regardless of the method of actuation or desired effect, the guidance system generally obtains information relating to the actual trajectory, compares the actual trajectory to the desired trajectory, and actuates at least one control surface to direct the ordnance delivery device in a certain manner. To coordinate these tasks, a guidance system generally includes an electronic control system, whether physically connected to the ordnance delivery device or in communication with it.

In summary, there are many possible designs for building a guidance system. Obtaining information pertinent to calculation of the actual trajectory generally requires an information gathering device selected from at least one of many possibilities. Further, the actuation of the control surface may be performed by a variety of mechanisms. In addition, the desired effects are various. Given this complexity, the approach to constructing an electronic control system has generally been the implementation of unique electronic control system for each combination of information gathering devices, control surface mechanisms, and desired effects.

SUMMARY OF THE INVENTION

A guidance system according to various aspects of the present invention operates in conjunction with a suite of different ordnance delivery devices. In one embodiment, the guidance system comprises an interface configured to attach to the ordnance delivery devices in the suite, such as via the fuze well. The guidance system may further include a control system adapted to attempt to establish communications with a subsystem of the ordnance delivery device, and to operate the guidance system as a standalone guidance system if the attempt fails. The guidance system may further include an interchangeably attachable control surface, for example via an interchangeable control surface module.

BRIEF DESCRIPTION OF THE DRAWING FIGURES

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks may be realized by any number of hardware or software components configured to perform the specified functions and achieve the various results. For example, the present invention may employ various machines, processors, and integrated circuit components, e.g., communication systems, sensors, buffers, memory elements, signal processing elements, logic elements, look-up tables, actuators, and the like, which may carry out a variety of functions under the control of one or more microprocessors or other control devices. In addition, the present invention may be practiced in conjunction with any number of weapon systems and transports, and the system described is merely one exemplary application for the invention. Further, the present invention may employ any number of conventional techniques for connections, assembly, component interfacing, data processing, component handling, actuating, guiding, navigating, and the like.

Figure 1:
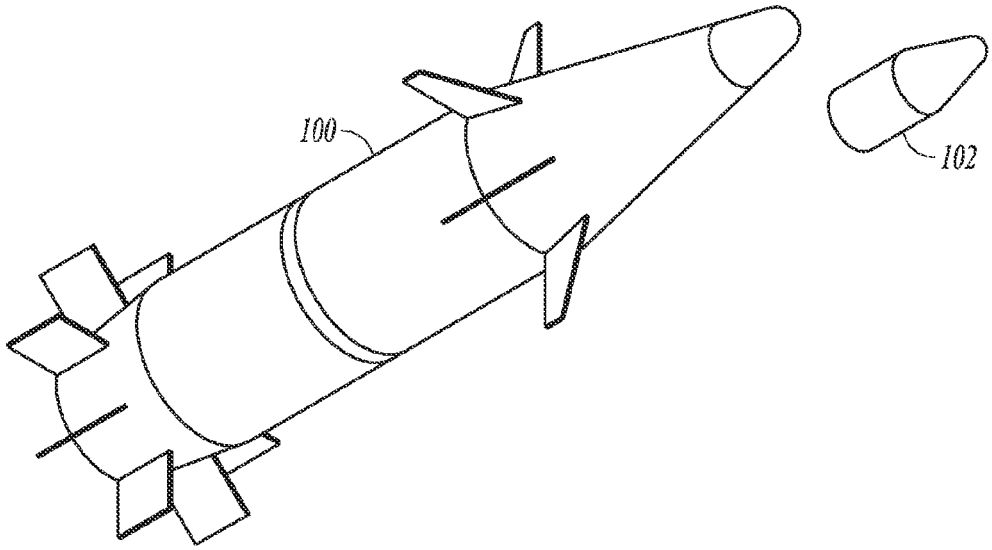
FIG. 1 illustrates an exemplary ordnance delivery device and a guidance system.

Referring now to FIG. 1, a modular guidance system 102 according to various aspects of the present invention operates in conjunction with an ordnance delivery device 100. The ordnance delivery device 100 may comprise any suitable system for delivering ordnance, such as gun shells, gravity bombs, torpedoes, missiles, rockets, and/or the like. For example, in one embodiment, the ordnance delivery devices 100 may comprise a suite of gun-fired shells, such as a suite of 155 mm howitzer shells including the XM 982 M107, M795, and M549A1.

The guidance system 102 supplements the ordnance delivery device 100, for example to provide improved navigation and/or guide the ordnance delivery device 100 to a target or along a selected path. The guidance system 102 is configured to connect to and operate with the suite of different ordnance delivery devices 100, and may be adapted to connect to any of the ordnance delivery devices 100 in the suite in the field, such as at a launch or deployment site for the ordnance delivery device 100, well after initial fabrication and delivery.

Figure 2:
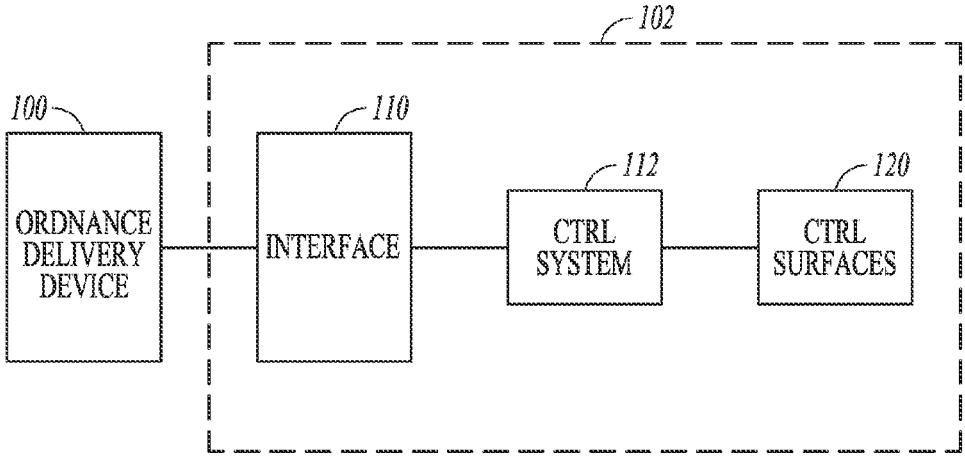
FIG. 2 is a block diagram of an exemplary ordnance delivery device and a guidance system.

The guidance system 102 may be configured in any suitable manner to be connected to multiple different types of ordnance delivery devices 100. For example, referring to FIG. 2, the guidance system 102 may comprise an interface 110 and a control system 112. In various embodiments, the guidance system 102 may further include one or more control surfaces 120. The interface 110 is connectable to multiple different types of ordnance delivery devices 100 such that the guidance system 102 may be operate in conjunction with the different types of ordnance delivery devices 100 in the suite. The interface 110 may be coupled to the control system 112, which controls the guidance and/or other functions of the ordnance delivery device 100 and/or the guidance system 102. The control surfaces 120 are also connected to the control system 112, and may comprise one or more control surfaces responsive to the control system 112 and be adapted to change the path of the ordnance delivery device 100.

Figure 3:
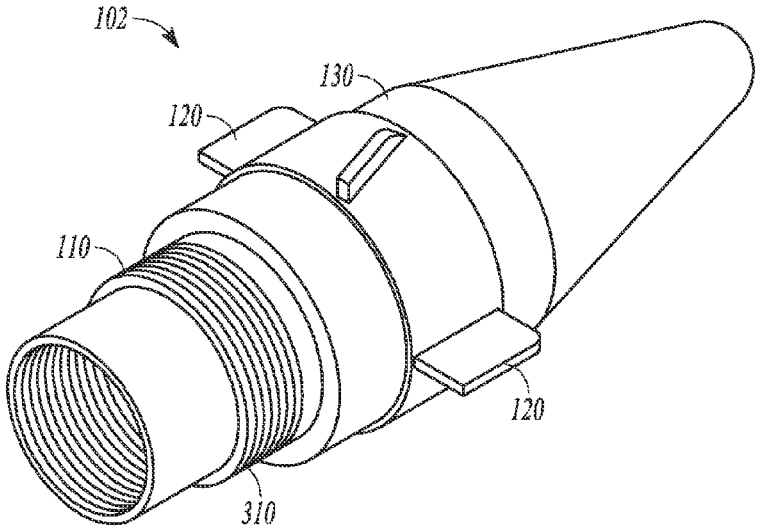
FIG. 3 illustrates an exemplary guidance system.

Referring to FIG. 3, in one embodiment, the guidance system 102 comprises a housing 130 adapted to house elements of the guidance system 102 and provide an exterior surface compatible with the application and/or environment of the ordnance delivery device 100. The housing 130 may comprise any appropriate system adapted to support and/or contain one or more elements of the guidance system 102, and may be adapted to a particular application, such as to minimize drag and/or conform to the dimensions of the ordnance delivery device 100. In the present embodiment adapted to connect to projectiles such as a gun-launched shell, rocket, and/or missile, the housing 130 is substantially symmetrical about a principal longitudinal axis, such as in the form of a cylinder, cone, or a combination of shapes. The housing 130 also comprises an appropriate material, such as a light, durable material capable of withstanding the shock of a gun launch and collisions with debris and weather. In the present embodiment, the housing 130 contains the control system 112, and the interface 110 is attached to the housing 130, such as by integration into the housing 130 or via a mechanical connection like threads, fasteners, adhesives, clamps, bolts, rivets, and the like. One or more elements of the control surfaces 120 may also be mounted on the housing 130.

The interface 110 facilitates connecting the guidance system 102 to the ordnance delivery device 100, such as physically and/or to facilitate communications between the control system 112 and systems of the ordnance delivery device 100 (if any), such as guidance electronics, control surfaces, sensors, propulsion systems, navigational systems, and detonation systems. The interface 110 may comprise any appropriate structures, materials, and elements for connecting to the ordnance delivery device 100, and may perform other functions as well as physical connection and/or communication linking.

A physical connection provided by the interface 110 may be configured according to the application and environment of the ordnance delivery device 100 and/or guidance system 102. For example, the interface 110 of the present guidance system 102 for connection to a suite of ordnance delivery devices 100 may provide a secure, removable connection to a portion of the ordnance delivery device 100. The present interface 110 may couple to the fuze well of a suite of ordnance delivery devices 100. In one embodiment, the interface 110 includes a threaded exterior surface 310 of the housing 130 adapted to engage a threaded interior surface of the ordnance delivery devices' 100 fuze wells.

Depending on the parameters of the various fuze wells in the suite of compatible ordnance delivery devices 100, the interface 110 may comprise various dimensions. If the suite includes ordnance delivery devices 100 having fuze wells comprised of disparate materials, the interface 110 may be configured to be compatible with these disparate materials so as to avoid adverse chemical reactions such as those causing embrittlement. If the suite includes substantially cylindrical fuze wells having disparate diameters, the interface 110 may include a coupling surface compatible with disparate diameters. The interface 110 may further include gaskets, fittings, compliant membranes, compliant fasteners, and/or the like suitably configured to couple the interface 110 to the various fuze wells of the suite of ordnance delivery devices 100.

Thus, to physically connect the guidance system 102 to the ordnance delivery device 100, the guidance system 102 may be screwed into the fuze well of the selected ordnance delivery device 100, facilitating field installation of a screw-in guidance system 102. The interface 110 may be adapted, however, according to any appropriate application to provide a suitable physical connection to the ordnance delivery device 100. Use of a standard part that operates with multiple ordnance delivery devices 100 permits relatively large production runs and associated reductions in cost, complexity, and inventory.

The interface 110 may further facilitate communications between subsystems of the ordnance delivery device 100, such as control, fuze, and/or sensor elements in the ordnance delivery device 100, and the guidance system 102. The interface 110 may include any suitable communication elements, such as mechanical, optical, wireless, infrared, acoustic, and/or electronic connections. In addition, the communications link of the interface 110 may be implemented in any suitable portion of the guidance system 102 and connect to any appropriate portion of the ordnance delivery device 100.

In one embodiment, the interface 110 includes one or more electrical connectors on the exterior or interior of the housing 130 that make electrical connections with corresponding connectors on the ordnance delivery device 100, such as via direct contact between connectors or via another medium, such as a cable, ribbon, or rigid connector. The interface 110 may comprise, however, any appropriate external or internal link to facilitate communication between the ordnance delivery device 100 and the guidance system 102. In the present embodiment, referring to FIGS. 4 and 5, the communication link is implemented via an axial pin 240 connected between the control system 112 and the interface 110. The axial pin 240 may house communication elements, such as wires or optical media, or may itself comprise an electrical connector.

The control system 112 controls the operation of the guidance system 102 and/or other systems connected to the guidance system 102. The control system 112 may comprise any appropriate systems for controlling the guidance system 102 and/or other systems, such as sensors, processors, storage elements, navigational systems, guidance systems, and communication systems. In the present embodiment, the control system 112 comprises one or more sensors, such as target sensors and/or position sensors, and/or navigation systems, such as global positioning system receivers and/or inertial navigation systems. In addition, the control system 112 may include one or more communication systems, such as for receiving commands, target information, and/or positional information and communicating status information. The control system 112 may be adapted to communicate with the ordnance delivery device 100 subsystems, and may further include a control surface interface for controlling the control surfaces. The control system 112 may include any other appropriate systems, such as fuze safe/arm (FSA) systems, actuators for control surfaces 120, power sources, memory devices, processors, switches, communication elements, and software programs.

The control system 112 may be adapted to be packaged in the guidance system 102. For example, the control system 112 (or a portion of the control system 112) may comprise a circular circuit board having a diameter to match the housing 130. The circuit board may include an exterior edge comprising a hard material to protect the interior components of the guidance system 102 and provide a substantially streamlined surface and continuity along the curvilinear exterior surface of the guidance system 102. The circuit board may be further configured to couple to other elements of the control system 112 and/or other systems and modules. The control system 112 may thus be removable from the guidance system, such as for replacement, maintenance, or modularity.

The navigation system controls the flight path of the ordnance delivery device 100 via the control surfaces 120. The navigation system may comprise any suitable system for controlling the trajectory of the ordnance delivery device 100, such as a computer for guiding the ordnance delivery device 100 along a preprogrammed trajectory or a conventional navigation system adapted to identify and adjust the trajectory of the ordnance delivery device 100 to conform to a desired trajectory. The navigational system may include any appropriate systems for identifying actual trajectory information for the ordnance delivery device 100, such as information relating to the acceleration, velocity, position, rotation, and/or projected time of arrival of the ordnance delivery device 100. The information may be generated by any appropriate onboard or remote systems, such as global positioning satellite systems, inertial guidance systems, accelerometers, magnetometers, gravitometers, laser seekers, infrared sensors, radar sensor, and target discrimination systems.

The navigation system may control the control surfaces 120 and/or ordnance delivery device 100 subsystems according to the trajectory information, the desired trajectory, desired flight characteristics, and/or other appropriate criteria. For example, the navigation system may compare the ordnance delivery device's 100 current trajectory information or other actual flight characteristic to the desired trajectory or flight characteristic and generate corresponding signals, such as electronic, optical, acoustic, pneumatic, or mechanical signals. The signals may be applied to the control surfaces 120 and/or ordnance delivery device 100 subsystems via the interface 110 to affect the trajectory of the ordnance delivery device 100.

The control system 112 provides an interface to the ordnance delivery device 100 and its control requirements and sensors. The control system 112 may communicate with the ordnance delivery device 100, for example via the communications link of the interface 110. The communications may comprise any appropriate communications, such as to control one or more control surfaces, propulsion systems, or other operations of the ordnance delivery device 100 by the control system 112, receive sensor data from the ordnance delivery device 100 sensors, provide sensor data to ordnance delivery device 100 control systems, provide fuze signals to the ordnance delivery device 100 systems, and/or arbitrate command of ordnance delivery device 100 and control system 112 subsystems. For example, the ordnance delivery device 100 may include one or more subsystems, such as sensors, control systems, control surfaces, navigational systems, flight management systems, propulsion systems, detonation systems, and other resources. The control system 112 may communicate with one or more of these ordnance delivery device 100 subsystems via the interface 110, for example to coordinate guidance of the projectile such that the control surfaces of the ordnance delivery device 100 and the control surfaces of the guidance system 102 are coordinated to properly guide the ordnance delivery device 100, to supplement the sensor information processed by the ordnance delivery device 100 systems, and the like.

In the present embodiment, the control system 112 is adapted to determine whether the ordnance delivery device 100 is configured to communicate with other systems. If the ordnance delivery device 100 is so configured, the control system 112 may further communicate with the ordnance delivery device 100 to control the trajectory or other characteristics of the ordnance delivery device 100. For example, the control system 112 may be adapted to communicate with multiple ordnance delivery devices 100, such as each of the ordnance delivery devices 100 in the suite of compatible ordnance delivery devices 100. The control system 112 may communicate with the ordnance delivery devices 100 using different communication protocols, and may select the appropriate protocol according to any appropriate criteria.

For example, the control system 112 may be provided or may request identification information for the ordnance delivery device 100 to which it is coupled. The control system 112 may then communicate with the ordnance delivery device 100 using the appropriate communication protocol. Alternatively, the control system 112 may poll the ordnance delivery device 100 using different candidate protocols and proceed with communications when a suitable communications protocol is found, such as when the ordnance delivery device 100 responds to a particular command from a particular communications protocol.

If communication is established between the control system 112 and one or more ordnance delivery device 100 subsystems, the control system may interoperate with the ordnance delivery device 100 subsystems. For example, the control system 112 may assert control over the ordnance delivery device 100 control surfaces to guide the ordnance delivery device 100. In addition, the control system 112 may receive sensor data and/or status data from the ordnance delivery device 100 to assist in the navigation and deployment of the ordnance delivery device 100. In the present embodiment, the control system 112 establishes communication with the ordnance delivery device 100 and determines the type of the ordnance delivery device 100. The control system 112 may control and/or otherwise utilize the ordnance delivery device 100 resources according to the type of the ordnance delivery device 100. Communication protocols, resource descriptions, and algorithms for using such resources may be stored in a memory accessible to the control system 112. Thus, the control system may receive sensor data from the ordnance delivery device 100, control the control surfaces of the ordnance delivery device 100, and/or otherwise control or supplement the deployment of the ordnance delivery device 100.

When the control system 112 does not establish communications with the ordnance delivery device 100, the control system 112 may default to independent operation without communication with the ordnance delivery device 100. For example, the control system 112 may operate as a conventional projectile guidance kit and fuze. Thus, if communications are not established, the guidance system 102 operates as a standalone precision guidance kit, but if communications are established, the guidance system 102 may interoperate with ordnance delivery device 100 subsystems, such as operating as a navigation aid and fuze to the ordnance delivery device 100. For a conventional unguided artillery shell, the guidance system 102 may provide additional functionality, such as FSA functions, actuators for the control surfaces 120, and navigational systems to guide the ordnance delivery device 100. For an ordnance delivery device 100 already equipped with various capabilities such as FSA functions and actuated control surfaces, the guidance system 102 may provide supplementary capabilities, such as additional or replacement FSA functions, actuators for additional controls surfaces, and additional navigation capabilities. In one embodiment, the guidance system 102 may operate as a distributed Multi Agent Reasoning System (dMARS) control interface (DCI) [?] and/or a Deeply-Integrated Navigation and Guidance Unit (DIGNU) for the ordnance delivery device 100. The control system 112 may include any appropriate level of functionality, ranging from controlling simple range adjustments with an air brake to providing target acquisition and discrimination capabilities to detect, discriminate, and engage specified targets located in complex environments.

The guidance system 102 may include one or more control surfaces, or the control surfaces 120 may be omitted from the guidance system 102. The control surfaces 120 may impart various forces and torques on coupled systems and devices. The control surfaces 120 may comprise any appropriate mechanisms for affecting the trajectory of the ordnance delivery device 100, such as aero-surfaces which impart force according to aerodynamic principles, directed ejecta which impart force according to principles of rocketry, a gyroscope which imparts a force according to principles of angular momentum, or other suitable mechanisms. In the present embodiment, the control surfaces 120 comprise aero-surfaces such as moveable fins and canards.

The control system 112 may control the control surfaces 120 of the guidance system 102, or the control surfaces may operate independently of the control system 112. For example, the control system 112 may control the control surfaces 120 via one or more actuators, and the control surfaces 120 may actuate in response to signals from the control system 112.

The control surfaces 120 may be coupled to the ordnance delivery device 100 to modify the motion of the ordnance delivery device 100 along and/or about the principal axis 135 of the ordnance delivery device, thus providing one or more degrees of freedom (DOF). In the Cartesian coordinate system, three dimensions are defined by the intersection of three normal axes, the x axis, the y axis, and the z axis. Motions along one of these axes define one DOF. Rotations about one of these axes define a distinct DOF. Motions along each of the three axes comprise three distinct degrees of freedom, and rotations about each of the three axes comprise three distinct degrees of freedom. The rate at which motion or rotation takes place comprises a seventh degree of freedom. Other coordinate systems, however, such as polar coordinates, may be suitably applied to describe the possible motion of the ordnance delivery device 100.

In various embodiments, the selectively actuated aero-surfaces may be configured to provide 1-DOF control, such as where the only substantial net effect of the deployed aero-surface is an increase or decrease in drag along the principal axis of the ordnance delivery device 100. Selectively deployed aero-surfaces may be configured to provide higher DOF control in configurations where the net effect of the deployed aero-surface is more complex. In this configuration, the selectively deployable aero-surfaces may impart both a resultant force along one or more axes as well as rotation about at least one axis.

Figure 4:
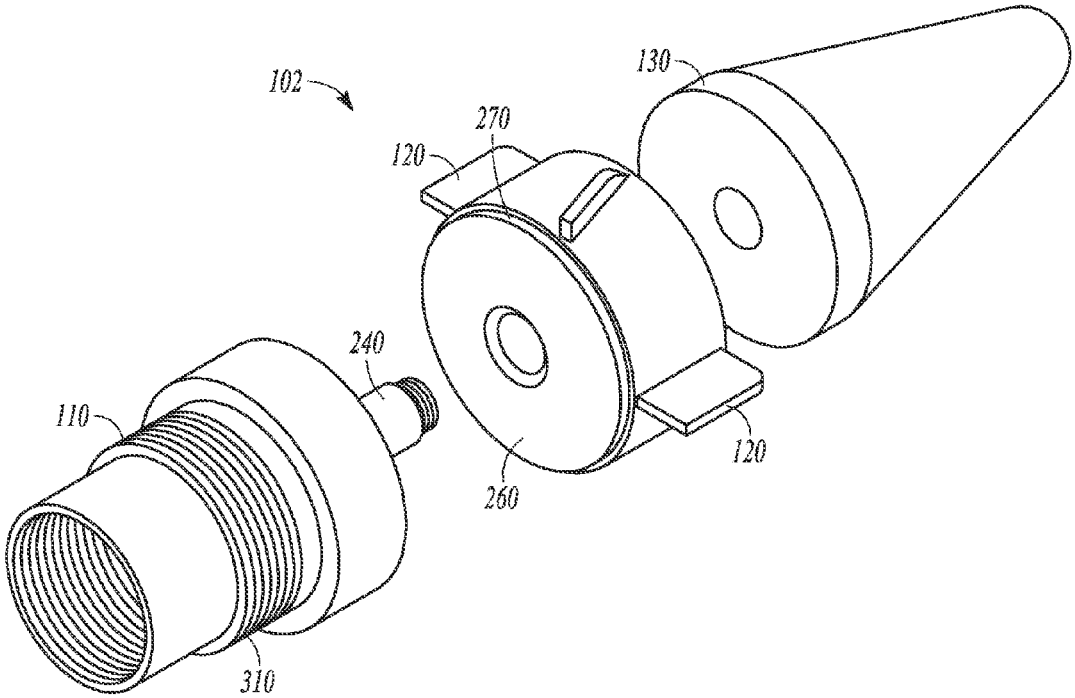
FIG. 4 is an exploded view of an exemplary guidance system.
Figure 5:
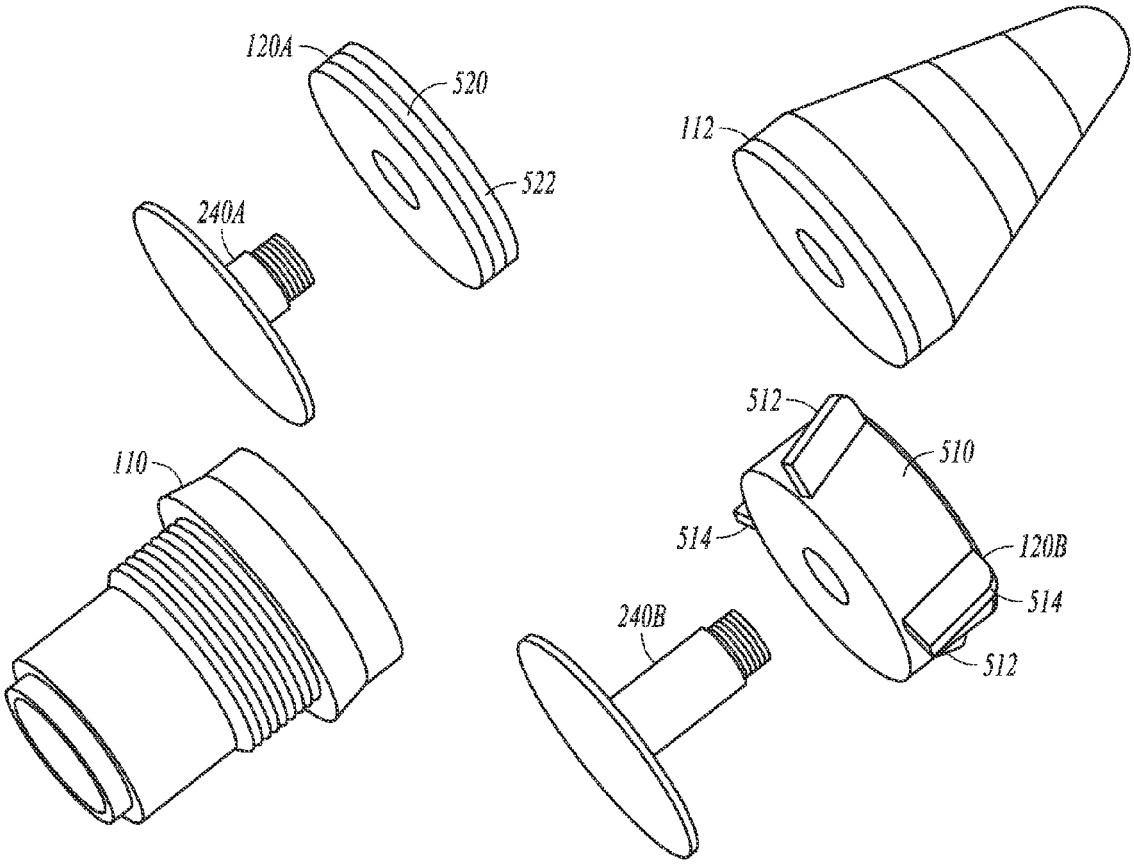
FIG. 5 is an exploded view of an exemplary guidance system having two candidate axial pins and control surface modules.

For example, referring to FIGS. 3 through 5, in one embodiment the control surfaces 120B may comprise four aero-surfaces fixed on a selectively rotatable substantially cylindrical structure 510. Two aero-surfaces 512 may impart a lift force having a force component substantially normal to the principal axis of the coupled ordnance delivery device 100. The remaining two aero-surfaces 514 may impart a torque substantially about the principal axis of the coupled ordnance delivery device 100. In operation, the substantially cylindrical structure 510 rotates independently of the coupled ordnance delivery device 100 and the aero-surfaces 512, 514 do not substantially produce a net effect on the coupled ordnance delivery device 100. When the rotating cylindrical structure 510 is de-rotated, as by a brake coupled with an optical encoder, the force imparted by the lift aero-surfaces 512 may direct the coupled ordnance delivery device 100 along the principal axis of the coupled ordnance delivery device, for example decelerating the ordnance delivery device 100. The lift aero-surfaces 512 may also impart a force along a second axis normal to that principal axis. In this way, a 2-DOF control surface affects motion along two axes.

Different configurations of control surfaces 120 may provide one DOF or more than two DOF, such as seven DOF. For example, referring to FIG. 5, the control surfaces 120 may comprise one or more releasable air brakes 520 adapted to selectively extend away from the exterior surface of the guidance system 102 and into the airstream around the ordnance delivery device 100 to increase drag. Thus, the air brakes 520 may provide 1-DOF control surfaces 120.

Referring still to FIG. 5, in one embodiment, the control surfaces 120 are interchangeably attached to the housing 130 so that the control surfaces may be selectively mounted and/or replaced on the guidance system 102. For example, the control surfaces 120 may be mounted on the guidance system 102 using interchangeable control surface modules 120A, 120B, each of which is adapted to be mounted on the guidance system 102. Thus, the guidance system 102 may be equipped with different types of control surfaces 120 for different characteristics and objectives. For example, if a particular mission requires a 2-DOF set of control surfaces 120, then the appropriate control surface module having the appropriate set of control surfaces 120B may be mounted on the guidance system 102. If another mission requires only a 1-DOF module, the 2-DOF module may be removed and replaced with a 1-DOF module having an appropriate set of control surfaces 120A. The control modules and the guidance system 102 may be configured such that the removal and replacement of control surface 120 modules may be performed in the field.

In one embodiment, the control surface 120 module may be physically mounted on the housing 130 and connected to the control system 112 to facilitate control of the control surface 120 module. For example, referring again to FIG. 4, the axial pin 240 and one or more non-axial pins 270 may provide and maintain physical alignment of the control surface module and the housing 130. In this embodiment, the axial pin 240 passes through a corresponding aperture 260 in the control surface 120 module and further couples to the housing 130. The coupled housing 130 substantially fixes the inner portion of the control surface 120 module. The non-axial pins 270 inhibit rotation of the control surface 120 module about the principal axis, and the axial pin 240, when coupled to the housing module 130, substantially impairs translation along the principal axis of the control surfaces 120.

The axial pin 240 may be an integrated structure of the interface 110 or the control system 112, or may be separate from the interface 110 and/or control system 112. For example, referring to FIG. 5, the axial pin 240 may be suitably configured for a given dimension, such as length, of a control surface module 320. When installing a different control module, the axial pin 240A may be replaced by another axial pin 240B suitably configured for the second control surface module 120B having a second distinct dimension such as length. The distinct dimension may also include radius, a tapered corresponding structure, a threaded corresponding structure, and/or the like. In other embodiments, the control surface modules may all have identical dimensions, allowing use of a single axial pin 240 with all control surface 120 modules. Alternatively, different control surface 120 modules and/or control systems 112 may be associated with different lengths of axial pins 240 to ensure that the appropriate control surface 120 module and/or control system 112 is used in combination with other elements. For example, a particular control surface 120 module and/or control system 112 may not be installable without using the correct axial pin 240.

The control surfaces 120 may be connected to the other elements of the guidance system, however, in any appropriate manner. For example, a pin coupling the control surfaces 120 to the interface 110 and/or the housing 130 may be parallel to, instead of coincident with, the principal axis of the control surfaces 120. Alternatively, the housing 130 may be rendered substantially immobilized with respect to translations along its principal axis and rotations about its principal axis by a connection to the control surfaces 120 and a separate connection between the control surfaces 120 and the interface 110. The connections between the various elements may be any appropriate connectors, such as fasteners, rivets, adhesives, magnetic forces, and threaded connections.

Figure 6:
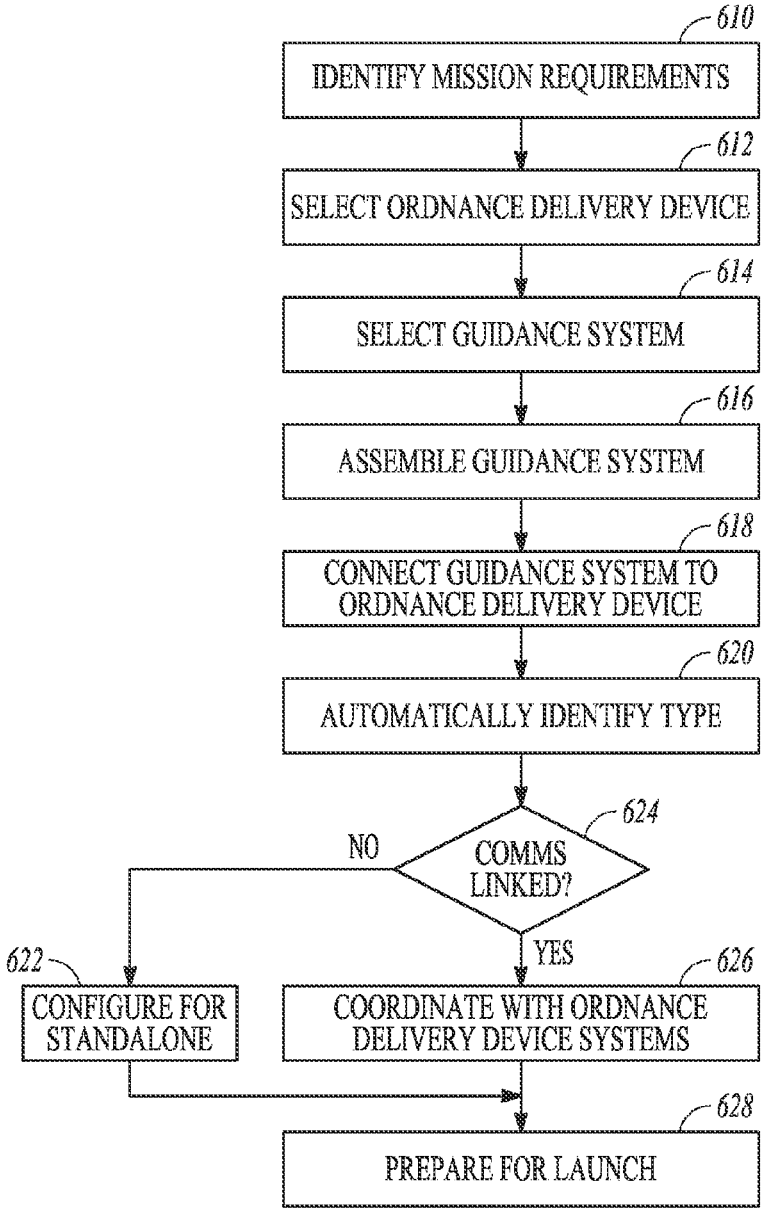
FIG. 6 is a flow diagram of a process for installing a selected guidance system on a selected ordnance delivery device.

Referring now to FIG. 6, the guidance system 102 may be coupled to the ordnance delivery device 100 for a particular mission. For example, a set of mission requirements may be established (610), such as a type of target, location, duration that the target will likely remain at the location, terrain and environment details, and other relevant information. The ordnance delivery device 100 and the guidance system 102 may be selected according to the mission requirements and any other relevant information (612, 614). For example, different ordnance delivery devices 100 may be selected for different types of targets, such as armored targets, targets in areas with high potential for collateral damage, and bunkers. Similarly, different guidance systems 102 may be selected for different targets and ordnance delivery devices 100, such as if the target is a hard target requiring high precision, a low priority target, a moving target, or a target in an area with collateral damage potential.

If the guidance system 102 operates with modular components, the various modules of the guidance system 102 may be selected and connected to the guidance system 102 (616). For example, the control system 112 and/or the control surfaces 120 module may be selected according to the relevant criteria, such as the mission requirements, and appropriately mounted on and/or connected to the guidance system 102. The guidance system 102 may then be mounted on the ordnance delivery device 100, for example by screwing the interface 110 into the fuze well of the ordnance delivery device 100 and making any other appropriate connections (618). The interface 100 may be fitted with gaskets, information transfer systems, adapters, and/or the like to make the connection between the ordnance delivery device 100 and the guidance system 102.

The suite of suitable ordnance delivery devices 100 may vary depending on the situation. Where the ordnance delivery device 100 may be fitted with a guidance system 102 at a factory, the suite of ordnance delivery devices 100 may include many members. Where the ordnance delivery device 100 may be fitted with a guidance system 102 in a field of operation, the suite of available ordnance delivery devices 100 may be relatively limited. The suite of ordnance delivery devices 100 may vary according to operation with other devices. Where the other devices include shoulder-fired devices, high weight ordnance would probably not be appropriate. If a control system 112 is not configurable for certain ordnance delivery devices 100, those ordnance delivery devices 100 would be effectively unavailable.

Likewise, the suite of control surfaces 120 may vary depending on situation. In a factory setting, the various control surface 120 modules may have higher availability than in a field of operation. Similarly, the suite of control surfaces 120 may vary according to operation with other devices. Some control surfaces 120 may be unsuitable for operation with some launch devices. Some control systems 112 may not be configured for operation with some control surfaces 120.

The best match of ordnance delivery device 100, control system 112, and control surfaces 120 may be determined according to a variety of factors. These factors may include whether multiple devices among the available suites of ordnance delivery devices 100 and control surfaces 120 would be sufficient to achieve the objectives. If multiple systems are suited to achieve the objectives, it may be desirable to select the least expensive. It may also be desirable to select from the most plentiful devices and modules such that backup systems may be readily assembled in the event of a misfire or otherwise unsuccessful mission. If certain devices and modules can be installed more quickly than others, this may be a factor.

If the assembled system is to be operable with other devices, this may also influence the determination. Other criteria may include age of the available components, cost of components, and other relevant criteria.

If the ordnance delivery device 100 supports communications, the ordnance delivery device 100 and the guidance system 102 may establish communications (624), for example via the interface 110. Communications may be established in any suitable manner, such as by manually initiating communications, the guidance system 102 sensing an identifier for the ordnance delivery device 100 and establishing communications accordingly, the guidance system 102 attempting to contact the ordnance delivery device 100 using different initiating commands, or other appropriate techniques (626). In the present embodiment, the control system 112 of the guidance system 102 automatically establishes the type of ordnance delivery device 100 to which the guidance system 102 is connected (620). If communications cannot be established, the guidance system 102 may automatically operate in a standalone mode (622).

The guidance system 102 may also receive mission data, such as location and target data. For example, the mission data may relate to a desired path of an ordnance delivery device 100, including the manner of travel along the path as well as destination. These parameters may include a specified acceleration at a point, trajectory, velocity at a point, orientation at a point, time of impact, blast on impact, combinations thereof, and/or the like. Mission data may include trajectory parameters, time interval for estimation calculation, allowable error rate, mass of the coupled systems and devices, operability with coupled systems and devices, and/or the like. The control system 112 may be suitably coupled to various other modules and devices such as the selected control surfaces 120, the interface 110, and the selected ordnance delivery device 100.

The ordnance delivery device 100 is substantially primed for launch and control to a desired target (628). The ordnance delivery device 100 may be suitably configured for system tests to verify that all systems and devices have been properly installed. The ordnance delivery device 100 may be suitably configured for further installation into other systems and devices prior to launch.

Figure 7:
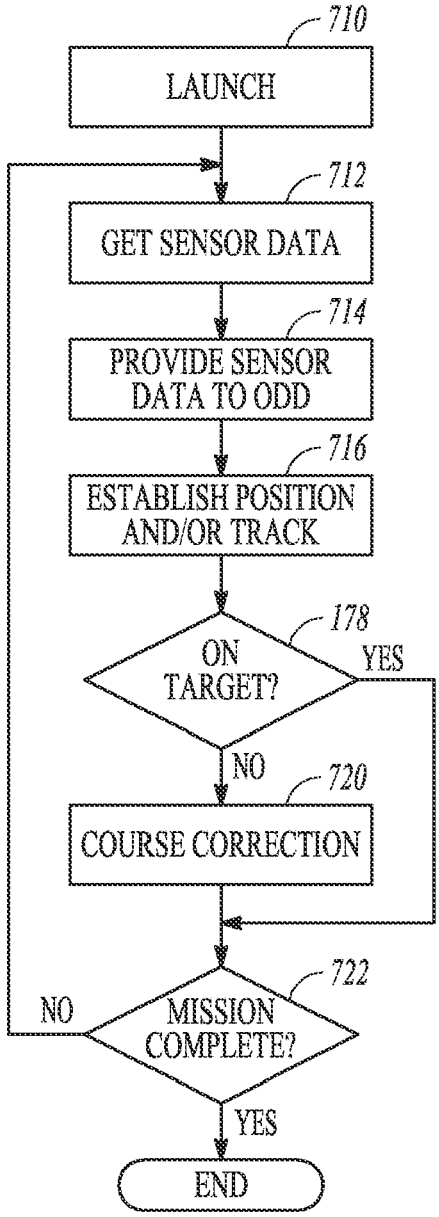
FIG. 7 is a flow diagram of a guidance process for guiding an ordnance delivery device.

Referring now to FIG. 7, the ordnance delivery device 100 may be launched (710), for example to destroy or disable a target. The control system 112 may acquire data from various sources, such as sensors, memory systems, and navigational systems, to accomplish the mission. For example, the control system 112 may acquire position and/or track data for the ordnance delivery device 100, such as from a GPS system associated with the control system 112 (712, 716).

The position and/or track data may be compared to the desired trajectory 430 (718). If the current position and/or track is within an allowable range of the desired trajectory, a course correction is not necessary and a control surface 120 actuator is not signaled. If the current position and/or track is not within an allowable range of the desired trajectory, a control surface 120 actuator is signaled to achieve a course correction (720).

In addition, the control system 112 may provide data to and/or receive data from the ordnance delivery device 100 (714). For example, the control system 112 may operate solely as a sensor enhancement, and may thus provide data to the ordnance delivery device 100 systems without operating any control surfaces 120. In alternative embodiments, the control system 112 may be configured to control subsystems of the ordnance delivery device 100 such that the control system 112 may communicate with the ordnance delivery device 100 to control the ordnance delivery device 100 subsystems. The process may repeat until the mission is complete (722).

The particular implementations shown and described are illustrative of the invention and its best mode and are not intended to otherwise limit the scope of the present invention in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

In the foregoing description, the invention has been described with reference to specific exemplary embodiments; however, various modifications and changes may be made without departing from the scope of the present invention as set forth. The description and figures are to be regarded in an illustrative manner, rather than a restrictive one and all such modifications are intended to be included within the scope of the present invention. Accordingly, the scope of the invention should be determined by the generic embodiments described and their legal equivalents rather than by merely the specific examples described above. For example, the steps recited in any method or process embodiment may be executed in any order and are not limited to the explicit order presented in the specific examples. Additionally, the components and/or elements recited in any apparatus embodiment may be assembled or otherwise operationally configured in a variety of permutations to produce substantially the same result as the present invention and are accordingly not limited to the specific configuration recited in the specific examples.

Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components.

The terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The present invention has been described above with reference to exemplary embodiments. However, changes and modifications may be made to the embodiments without departing from the scope of the present invention. These and other changes or modifications are intended to be included within the scope of the present invention, as expressed in the following claims.

The invention claimed is:

1. A guidance system for a suite of different ordnance delivery devices, comprising:

a housing;

an interface attached to the housing and configured to attach to the ordnance delivery devices in the suite; and a control system disposed within the housing, wherein the control system is adapted to:

attempt to establish communications with a subsystem of the ordnance delivery device; and operate the guidance system as a standalone guidance and fuzing system if the attempt fails.

2. A guidance system according to claim 1, further comprising a control surface module selected from a suite of control surface modules and interchangeably attached to the housing, wherein the control system is adapted to control each of the control surface modules in the suite of control surface modules.

3. A guidance system according to claim 2, wherein the suite of control modules includes control modules offering different degrees of freedom for guiding the ordnance delivery device.

4. A guidance system according to claim 1, wherein the interface is adapted to screw into a fuze well of the ordnance delivery device.

5. A guidance system according to claim 1, wherein the interface comprises a communications link adapted to convey communications between the control system and the subsystem of the ordnance delivery device.

6. A guidance system according to claim 1, wherein at least one of the ordnance delivery devices in the suite of ordnance deli very devices is a gun-fired shell.

7. A guidance system according to claim 1, wherein all of the ordnance delivery devices in the suite of ordnance delivery devices are gun-fired shells.

8. A guidance system according to claim 1, wherein the subsystem of the ordnance delivery device further comprises at least one of a control system, a propulsion system, a sensor, a control surface, and a navigation system.

9. A guidance system according to claim 1, wherein the control system further comprises a navigation system adapted to guide the ordnance delivery device.

10. A guidance system according to claim 9, wherein the navigation system is adapted to:

identify a current position of the ordnance delivery device; and compare the current position to a desired position of the ordnance delivery device.

11. A guidance system for a suite of ordnance delivery devices, each ordnance delivery device including a fuze well, comprising:

a housing comprising a threaded surface adapted to engage the fuze wells of the ordnance delivery devices;

a control surface interchangeably attached to the housing; and a control system disposed within the housing and connected to the control surface, wherein the control system is adapted to:

control the actuation of the control surface;

attempt to establish communications with a subsystem of the ordnance delivery device; and operate the guidance system as a standalone guidance and fuzing system if the attempt fails.

12. A guidance system according to claim 11, wherein:

the control surface comprises a control surface module selected from a suite of control surface modules; and the control system is adapted to control each of the control surface modules in the suite of control surface modules.

13. A guidance system according to claim 12, where in the suite of control modules includes control modules offering different degrees of freedom for guiding the ordnance delivery device.

14. A guidance system according to claim 11, further comprising a communications link adapted to convey communications between the control system and the subsystem of the ordnance delivery device.

15. A guidance system according to claim 11, wherein at least one of the ordnance delivery devices in the suite of ordnance delivery devices is a gun-fired shell.

16. A guidance system according to claim 11, wherein all of the ordnance delivery devices in the suite of ordnance delivery devices are gun-fired shells.

17. A guidance system according to claim 11, wherein the subsystem of the ordnance delivery device comprises at least one of a control system, a propulsion system, a sensor, a control surface, and a navigation system.

18. A guidance system according to claim 11, wherein the control system comprises a navigation system adapted to guide the ordnance delivery device.

19. A guidance system according to claim 18, wherein the navigation system is adapted to:

identify a current position of the ordnance delivery device; and compare the current posit ion to a desired position of the ordnance delivery device.

20. A method for controlling an ordnance delivery device having a fuze well, comprising:

connecting a guidance system to the fuze well of the ordnance delivery device;

attempting to establish communications between the guidance system and a subsystem of the ordnance delivery device; and operating the guidance system as a standalone guidance and fuzing system if the attempt fails.

21. A method according to claim 20, further comprising:

connecting an interchangeable control surface module to the guidance system; and controlling the actuation of a control surface of the control surface module.

22. A method according to claim 20, further comprising selecting the ordnance delivery device from a suite of ordnance delivery devices.

23. A method according to claim 20, further comprising:

selecting a control surface module from a suite of control surface modules; and mounting the selected control surface module on the guidance system.

* * * * *

UNITED STATES PATENT AND TRADEMARK OFFICE

CERTIFICATE OF CORRECTION

PATENT NO. : 8,124,921 B2
APPLICATION NO. : 12/340950
DATED : February 28, 2012
INVENTOR(S) : Geswender et al.

It is certified that error appears in the above-identified patent and that said Letters Patent is hereby corrected as shown below:

In column 13, line 27, in Claim 6, delete "deli very" and insert -- delivery --, therefor.

In column 14, line 32, in Claim 19, delete "posit ion" and insert -- position --, therefor.

Signed and Sealed this
Twenty-ninth Day of May, 2012

David J. Kappos

David J. Kappos
*Director of the United States Patent and Trademark Office*